United States Patent [19]

Friedeberg

[11] 3,978,988

[45] Sept. 7, 1976

[54] PORTABLE GARAGE CLOTHESLINE HOLDERS

[76] Inventor: Donna Lea Berg Friedeberg, 103 Farmstead Lane, Glastonbury, Conn. 06033

[22] Filed: Aug. 26, 1974

[21] Appl. No.: 491,937

[52] U.S. Cl. ..... 211/113; 211/119.01; 248/215

[51] Int. Cl.[2] ..... D06F 53/04

[58] Field of Search ..... 211/113, 119.01, 119.1, 211/119.16, 119.17, 94, 94.5; 248/214, 215, 339, 340

[56] References Cited

UNITED STATES PATENTS

| | | | |
|---|---|---|---|
| 1,896,996 | 2/1933 | Beglinger | 211/119.1 |
| 2,040,746 | 5/1936 | Kniedler | 211/119.1 |
| 2,141,032 | 12/1938 | Cordell | 211/119.17 |
| 2,271,941 | 2/1942 | Kemmitt | 211/113 X |
| 2,312,803 | 3/1943 | Curtenius | 211/119.17 X |
| 2,480,327 | 8/1949 | Idelsohn | 211/113 |
| 2,587,150 | 2/1952 | Hansen et al. | 211/113 X |
| 2,670,169 | 2/1954 | Corpeny | 211/119.16 X |
| 2,972,419 | 2/1961 | Zelen et al. | 211/113 X |
| 3,146,890 | 9/1964 | Cowper | 211/119.1 X |

*Primary Examiner*—Roy D. Frazier
*Assistant Examiner*—Rodney H. Bonck

[57] ABSTRACT

A design for attaching a portable clothesline to an overhead garage door.

1 Claim, 3 Drawing Figures

FIG. 1
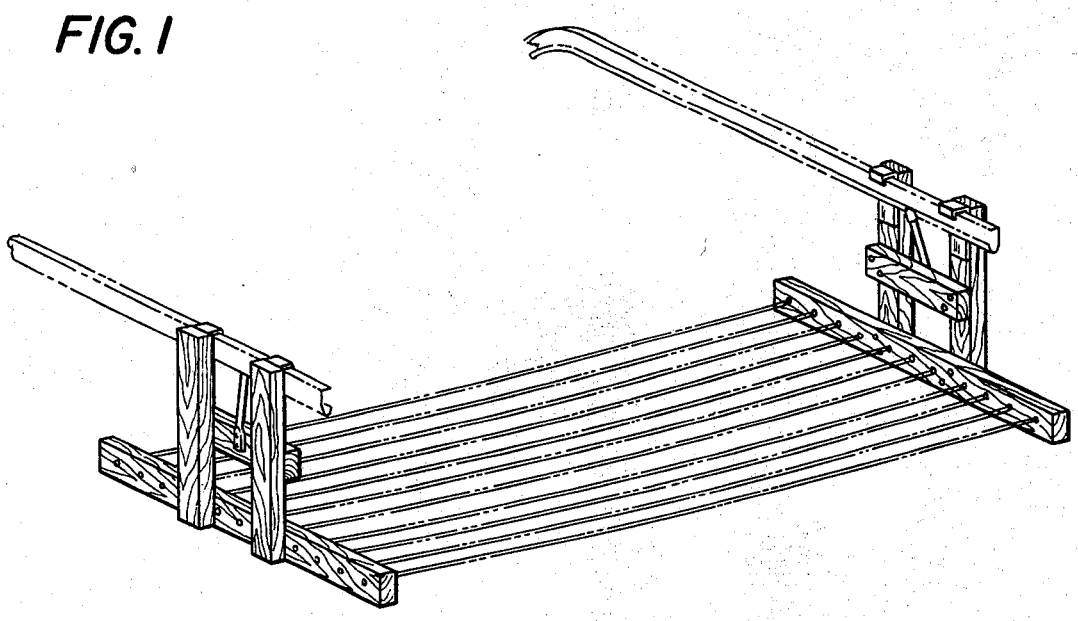
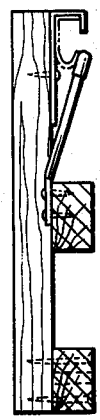
FIG. 3
FIG. 2
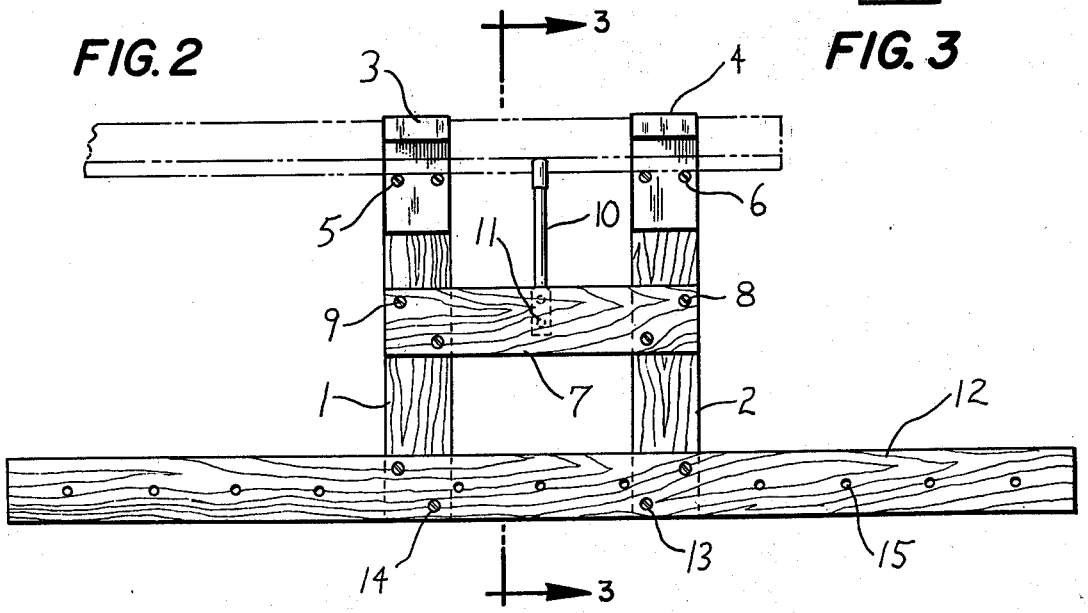

PORTABLE GARAGE CLOTHESLINE HOLDERS

SUMMARY OF THE INVENTION

A pair of braced Clothesline Holders which are to be suspended temporarily or permanently from the tracks of any standard overhead garage door by flat hooks which fit snugly down over the tracks and do not interfer with the operation of the garage door.

1. To provide clothesline overhead supports made precisely to fit down over the top of standard overhead garage door tracks without interfering with the operation of the garage door. 2. To provide an overhead clothesline exposed to sunlight and outdoor air without the inconvenience of going outside in homes which have attached garages. 3. To provide an overhead clothesline exposed to sunlight and outdoor air for prolonged periods during the day without concern over weather changes when everyone is absent from the house. 4. To provide an overhead clothesline exposed to sunlight and outdoor air which does not need to be removed after each use in order to avoid the unattractiveness of lines in the yard.

DESCRIPTION OF THE VIEWS OF THE DRAWINGS

FIG. 1 is a view of the pair of Clothesline Holders in operation on the tracks of the overhead garage door with lines suspended. It is viewed from slightly above, looking down onto the Clothesline Holders and lines as though from the back of the garage. FIG. 2 shows one Clothesline Holder in a front view. The Holder is attached to the garage door track. Behind it would be the side wall of the garage. The lines of the clothesline would come forward out of the drawing toward the viewer. FIG. 3 is a cut-away side view along A-A of FIG. 2 of the center section of one Clothesline Holder showing the attachment of the flat hook on the garage door track and the position of the center metal brace.

DETAILED DESCRIPTION OF THE INVENTION

The Clothesline Holder consists of two long beams, No. 1 and No. 2 in the drawings, which may be smoothly planed and finished wood or painted steel beams. To the end of each of the two beams and flush with the ends is attached a hook, No. 3 and No. 4 in the drawings, shaped like an incomplete rectangle of painted steel. The attachment of the hook is made so that the closed part of the rectangle is flush with the ends of the beams and the shorter side is above the longer side and both are above the wider side of the beam.

The Clothesline Holder is strengthened by a crossbeam, No. 7 in the drawings. The wide side of the wood crossbeam is attached to the wide side of the beams. In both cases the attachment is made on the same side that the hooks are attached. To the crossbeam is attached a brace, No. 10 in the drawings. An end-beam, No. 12 in the drawings, with spaced holes drilled, is attached flush to the non-hook ends of the beams on the same side as the crossbeam.

To use the Clothesline Holders, each is simply lifted up and hooked over the garage door tracks the braces are secured to the crossbeams and clotheslines are strung from one holder to the other. The Holders are removed by simply removing the brace and lifting the holder off the tracks and may be removed without the removal of the clotheslines.

The Clothesline Holders may be constructed from other appropriate materials such as tubular aluminum, heavy plastic, alloys, etc.

It must be understood that the invention is not limited to the particular form illustrated and described but may be modified in dimension and design within the scope of the claim which follows the disclosure.

I claim:

1. An overhead clothesline support adapted to be attached to an overhead garage door track, said support comprising a horizontally disposed elongated end-beam having two ends and having means along its length for attaching clothesline thereto, a pair of vertically disposed, spaced, beams each having a first end and a second end, the first end of each beam being secured to said end-beam intermediate the ends of the end-beam, a pair of J-shaped hooks opening downwardly and having a long leg and a short leg, the long leg of each hook being secured to the second end of a beam, said short leg of each hook lying in a plane spaced from the beams and being adapted to hook over the garage door track, a horizontally disposed crossbeam having ends and extending between the beams, said crossbeam being secured at its ends to the beams intermediate the first and second ends thereof, a brace extending upwardly from said crossbeam toward said plane of the hook short legs and said brace adapted to engage said garage door track to retain said J-shaped hooks in engagement with said track without interfering with garage door operation in said track.

* * * * *